United States Patent [19]

Simpson, Jr.

[11] Patent Number: 4,509,221

[45] Date of Patent: Apr. 9, 1985

[54] WATER DRIVEN SCRUBBER FOR HAND HELD SHOWER HEAD

[76] Inventor: Raymond A. Simpson, Jr., 609 Frontier Dr., High Point, N.C. 27263

[21] Appl. No.: 539,821

[22] Filed: Oct. 6, 1983

[51] Int. Cl.[3] ..... A46B 13/06

[52] U.S. Cl. ..... 15/29; 15/97 R

[58] Field of Search ..... 15/21 C, 21 D, 97 R, 15/24, 29; 128/47, 50, 53, 56, 62 R

[56] References Cited

U.S. PATENT DOCUMENTS

| | | | |
|---|---|---|---|
| 1,300,128 | 4/1919 | Cummings | 15/97 R X |
| 1,840,812 | 1/1932 | Hardy | 128/56 |
| 2,905,171 | 9/1959 | De Crescenzo | 128/53 |
| 4,228,558 | 10/1980 | Zhadanov | 15/29 |
| 4,282,623 | 8/1981 | Gacuzana | 15/29 X |
| 4,370,771 | 2/1983 | Gonzalvo | 15/29 |
| 4,378,804 | 4/1983 | Cortese, Jr. | 15/29 X |

*Primary Examiner*—Edward L. Roberts
*Attorney, Agent, or Firm*—Harvey B. Jacobson

[57] ABSTRACT

A scrubber assembly including a housing having first and second remote sides is provided and the housing includes rotary scrubber structure journalled therefrom facing and disposed outwardly of the first side of the housing. The second side of the housing includes liquid inlet structure and the housing contains a liquid driven motor including a rotary output shaft upon which the scrubber structure is mounted. The housing includes a liquid outlet structure and the motor is operative to receive liquid under pressure from the inlet structure, to discharge liquid from the liquid outlet structure and to develop rotary torque input to the shaft as a result of liquid flow therethrough from the inlet structure to the outlet structure. The housing includes structure coacting with an associated hand held spray head of the type including a flexible water inlet supply hose and a plurality of liquid spray jet outlets opening outwardly of one side of the head for releasably mounting the housing from the head with at least one of the spray jet outlets in sealed communication with the liquid inlet structure for the motor housing.

8 Claims, 6 Drawing Figures

WATER DRIVEN SCRUBBER FOR HAND HELD SHOWER HEAD

BACKGROUND OF THE INVENTION

There are numerous instances in which a supply of water or other liquid under pressure is available for cleaning purposes, but it is desired to effect a cleaning action with the cleaning liquid by a mechanical scrubbing action. Accordingly, a need exists for a form of mechanical scrubber which may be driven from a source of liquid under pressure.

Various different forms of liquid motors in operative association with a scrubbing unit and a source of cleaning liquid under pressure heretofore have been provided. Examples of such devices including some of the general structural and operational features of the instant invention are disclosed in U.S. Pat. Nos. 1,696,835, 2,178,943, 2,284,213 and 2,678,457.

BRIEF DESCRIPTION OF THE INVENTION

The scrubber of the instant invention includes a liquid motor driven rotary scrubbing brush and includes structure whereby the scrubber may be removably mounted from the water outlet side of a hand held shower head with the water inlet for the liquid motor of the scrubber in sealed communication with at least one of the water outlets of the hand held shower head. The scrubber includes a water outlet and a flexible drain hose extending therefrom whereby water used to drive the rotary scrubber may be discharged therefrom at a location remote from the rotary scrubbing head of the scrubber.

The main object of this invention is to provide a rotary scrubber for use in conjunction with a hand held shower head and constructed in a manner whereby the usual supply of water under pressure delivered to the hand held shower head may be used to drive the rotor of the rotary scrubber.

Another object of this invention is to provide an apparatus in accordance with the preceding objects and including structure whereby the discharge of water from the liquid motor of the scrubber may be effected at a location remote from the rotor of the scrubber.

Still another important object of this invention is to provide a rotary scrubbing attachment which may be readily adapted for use in conjunction with hand held shower heads of different types.

A final object of this invention to be specifically enumerated herein is to provide a rotary scrubber for a hand held shower head and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
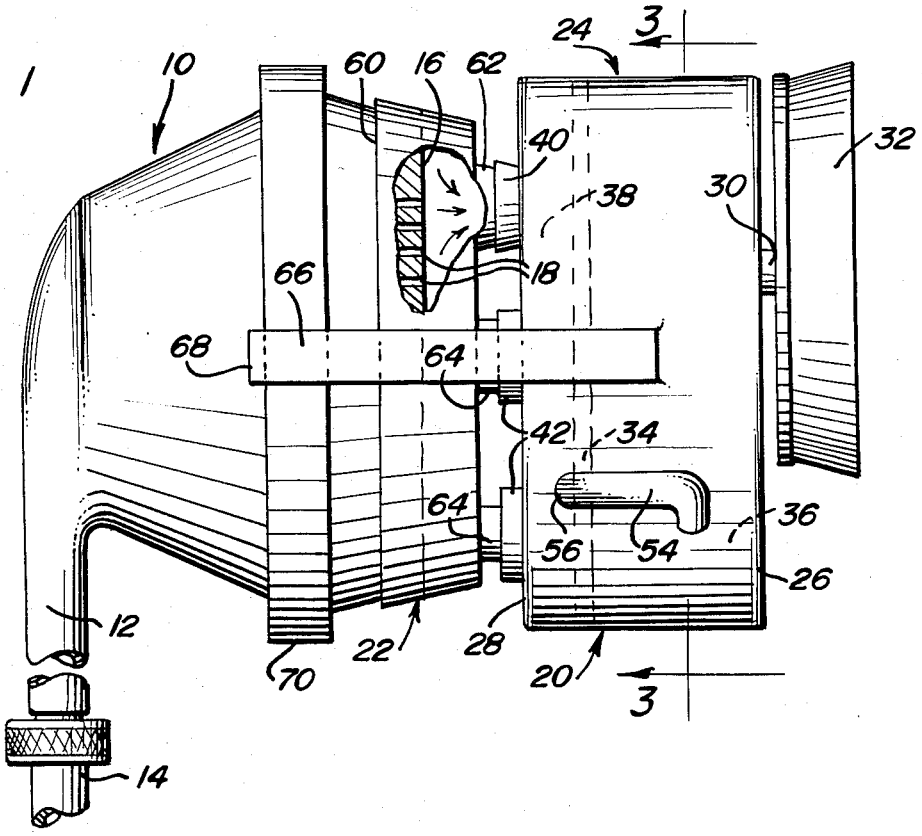
FIG. 1 is a side elevational view of a typical form of hand held shower head with a first form of rotary scrubber of the instant invention in operative association therewith, portions of the handle of the shower head being broken away.
Figure 2:
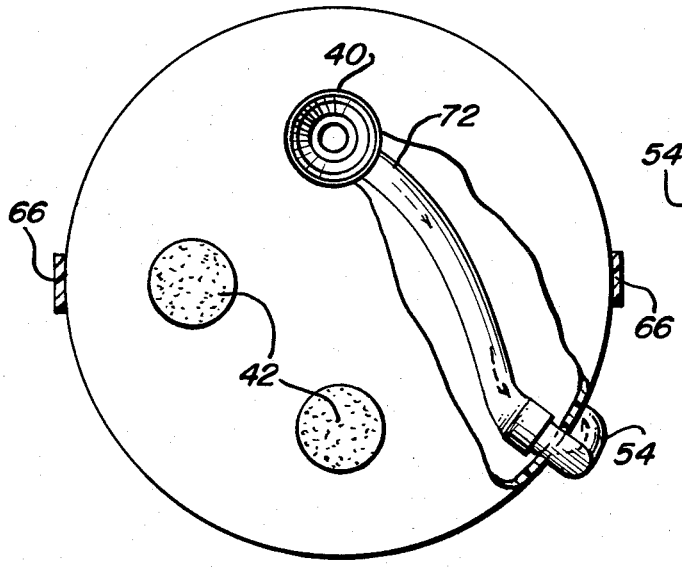
FIG. 2 is an elevational view of the water inlet side of the scrubber unit with portions thereof being broken away and portions of the mounting clips of the scrubber illustrated in vertical section.

Referring now more specifically to the drawings the numeral 10 generally designates a first form of conventional shower head including a laterally outwardly projecting tubular handle 12 to whose outer end the discharge end of a flexible water supply hose 14 is removably coupled.

The head 10 includes a first side 16 thereof outwardly through which a plurality of water outlets 18 open and the rotary scrubber of the instant invention is referred to in general by the reference numeral 20 and is operatively associated with the first water spray jet outlet side 16 of the head 10 through the utilization of an adapter cup referred to in general by the reference numeral 22.

The rotary scrubber 20 includes a substantially cylindrical housing referred to in general by the reference numeral 24 having first and second remote sides. A rotary driven shaft or rotor 30 is journalled through the first side 26 and has a circular scrubbing brush 32 mounted on its outer end. The interior of the housing 24 is divided, by a partition 34, into a rotor compartment 36 and a water inlet compartment 38. A generally frusto-conical and outwardly flaring water inlet fitting 40 is supported from the second side 28 and opens outwardly thereof and the second side 28 additionally includes resilient bumpers 42 supported therefrom.

The housing 24 includes a rotor body 44 mounted on the shaft 30 and the rotor body 44 includes peripherally spaced stiff but somewhat flexible blades 46 supported therefrom. The rotor body 44 is slightly eccentrically located within the chamber 36 and the latter includes a water inlet 48 as well as a water outlet 50. The inlet end of a flexible discharge hose 52 is removably coupled to the outlet 50 and the outlet end of a transfer pipe 54 opens into the water inlet 48 and the inlet end of the transfer pipe 54 receives water from the outlet 56 of the water inlet chamber 38.

The cup 22 includes an open inlet side 60 into which the first side 16 of the head 10 may be seatingly and sealingly telescoped and the openings 18 open into the cup 22. The cup 22 includes an outlet fitting 62 which is seatingly telescoped into the water inlet fitting 40 of the housing 24 and the cup 22 includes three outwardly projecting abutments 64 which abut the bumpers 42. Diametric opposite sides of the housing 24 include outwardly projecting generally parallel arms 66 equipped with hooked free end portions 68 and the head 10 includes a peripherally extending outer rib 70 over which the hooked ends 68 of the arms 66 may be removably engaged in order to removably support the housing from the head 10 with the cup 22 clamped between the head 10 and the housing 24.

Figure 3:
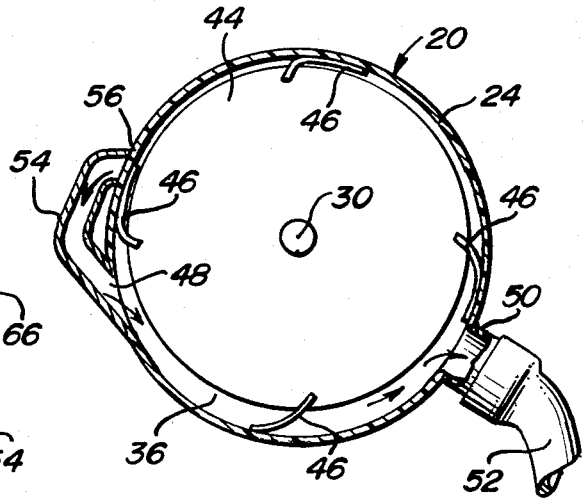
FIG. 3 is a vertical sectional view of the scrubber unit taken substantially upon the plane indicated by the section line 3—3 of FIG. 1.

In operation, the head 10 discharges water jets through the openings 18 into the closed end of the cup 22 remote from the head 10 and then passes through the outlet fitting 62 and the water inlet fitting 40 into the inlet end of a transfer hose 72 having its outlet end sealingly communicated with the inlet end of the transfer pipe 54. The water is discharged from the transfer pipe 54 into the compartment 36 and moves thereabout in a counterclockwise direction as viewed in FIG. 3 of the drawings in the expanding space between adjacent blades 46 and then exits from the compartment 36 via the water discharge 50 and discharge hose 52. Of course, the rotor body 44 is driven in a counterclockwise direction and thus rotates the brush 32 in the same direction. The discharge hose 52 may be of any suitable length and is operative to discharge the water from the compartment 36 at a location remote from the brush 32. Accordingly, the brush 32 may have a cleaning solution thereon not to be diluted by water being discharged from the compartment 36.

Figure 4:
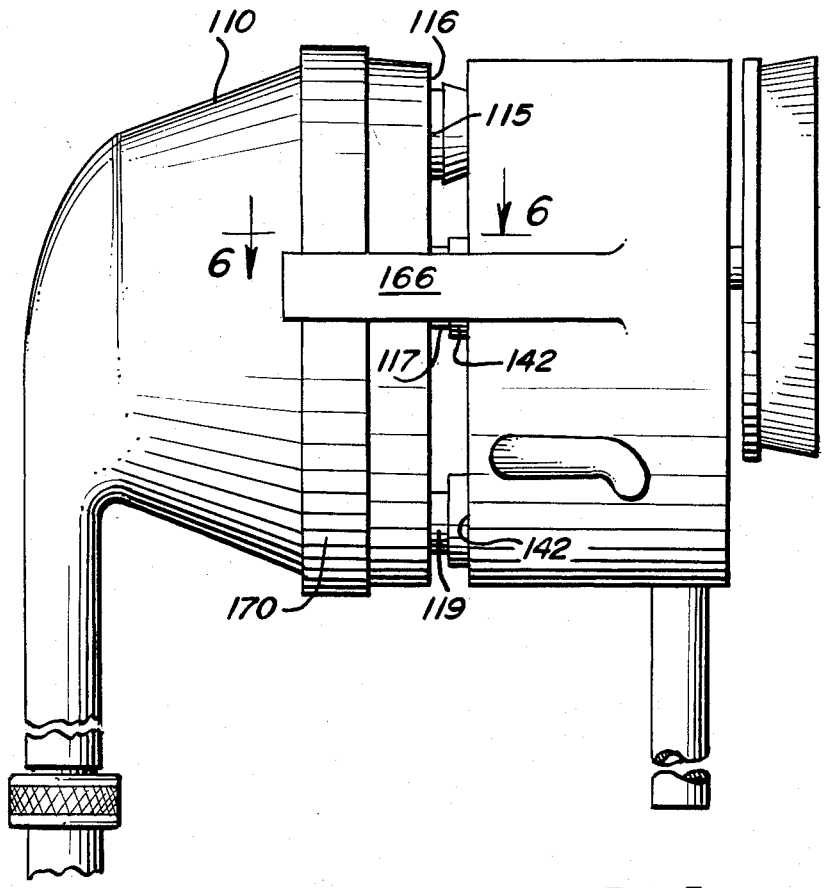
FIG. 4 is an elevational view similar to FIG. 1 but illustrating a modified form of scrubber in operative association with a slightly different form of shower head.

With attention now invited more specifically to FIG. 4, a modified form of hand held shower head is referred to in general by the reference numeral 110. The shower head 110 is generally similar to the shower head 10, except that the first side 116 of the head 110 includes four outwardly projecting independently usable water outlets 115, 117, 119 and 121. Further, the head 110 also includes a circumferential rib 170 corresponding to the rib or flange 70 and omits the adapter cup 22.

Figure 6:
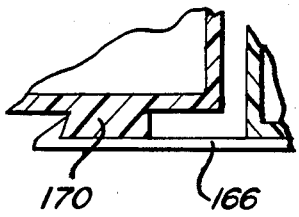
FIG. 6 is an enlarged fragmentary vertical sectional view taken substantially upon the plane indicated by the section line 6—6 of FIG. 4.
Figure 5:
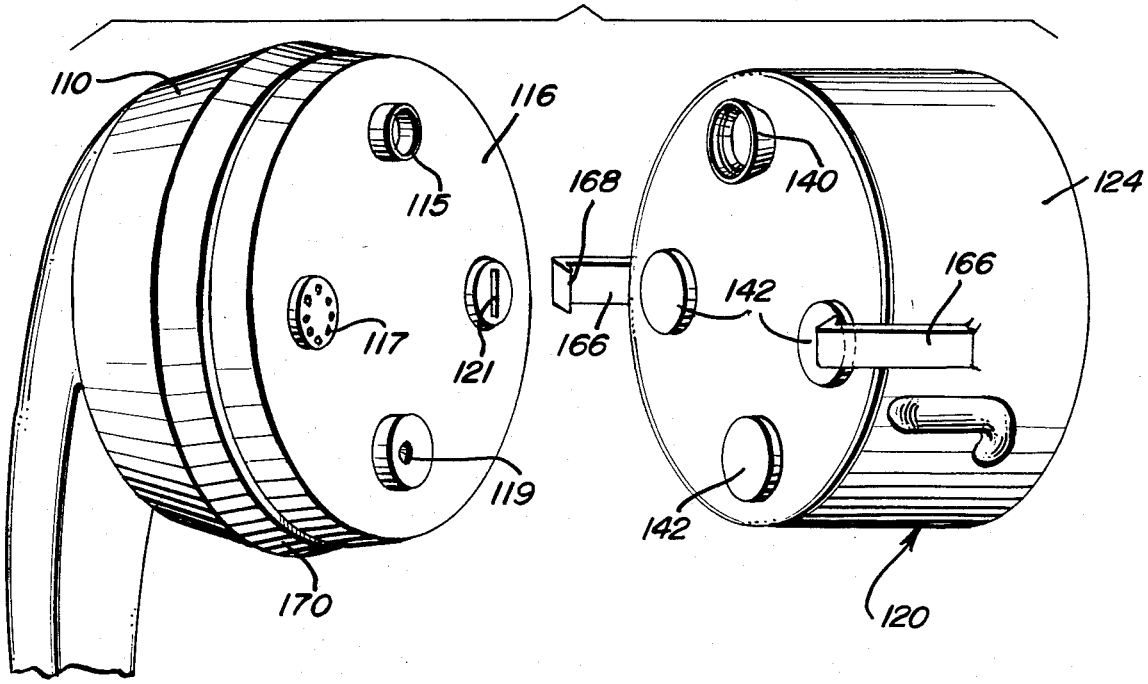
FIG. 5 is an exploded perspective view of the assemblage illustrated in FIG. 4.

The rotary scrubber to be used in conjunction with the head 110 is referred to in general by the reference numeral 120 and is identical in construction to the rotary scrubber 20, except that the arms 166 thereof are slightly shorter in length in order to compensate for the omission of the adapter cup 22. Thus, the arms 166 may be shorter. Otherwise, the arms 166 are engaged with the rib or flange 170 in the manner illustrated in FIG. 6 of the drawings to mount the housing 124 of the scrubber 120 from the head 110 with the housing 124 spaced slightly outwardly of the first side 116 of the head 110. The outlets 117, 119 and 121 abut against and are closed by the resilient bumpers 142 corresponding to the bumpers 42 and the outlet 115 is telescopingly received within the water inlet fitting 140 corresponding to the water inlet fitting 40. Thus, it may be seen that the rotary scrubber may be readily adapted for use either in conjunction with a hand held shower head such as that illustrated at 110 in FIGS. 4 and 5 or a shower head such as that indicated at 10 in FIG. 1.

Of course, the rotary scrubber 120 includes a water outlet and discharge hose corresponding to the components 50 and 52 of the rotary scrubber 20. It is further pointed out that the rotary scrubbers 20 and 120 need not be used in conjunction with a hand held shower spray head. Rather, the rotary scrubbers 20 and 120 may also be used in conjunction with other different forms of spray heads used for general cleaning purposes.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a hand-held shower spray head of the type including a flexible water inlet supply hose opening into said head on one side thereof through an elongated tubular handle projecting outwardly of said one side and wherein said head includes a plurality of liquid spray jet outlets opening outwardly of a side of said head remote from said handle, a scrubber assembly attachment including a housing having first and second remote sides, said housing including rotary scrubbing means journalled therefrom and facing and disposed outwardly of said first side, said second side including liquid inlet means, liquid motor means in said housing including a rotary output shaft upon which said scrubbing means is mounted, said housing including liquid outlet means, said motor means being operative to receive liquid under pressure from said inlet means, discharge liquid from said liquid outlet means and to develop rotary torque input to said shaft as a result of a liquid flow under pressure therethrough from said inlet means through said outlet means, said housing and head including means operative to releasably mount said housing from said head with at least one of said spray jet outlets in sealed communication with said inlet means.

2. The combination of claim 1 wherein said one side of said spray head includes a plurality of small spray jet outlets and said spray head is operable to discharge spray jets of liquid from said outlets simultaneously, said means operative to releasably mount said housing from said head including an adapter cup including a large inlet opening positionable over said one side of said spray head in at least reasonably good fluid-tight sealed engagement therewith and for receiving water from said plurality of small spray jet outlets, said adapter cup including a small liquid outlet remote from said large inlet opening and with which said liquid inlet means is sealingly communicated, said adapter cup being removably sandwiched between said one side of said spray head and said second side of said housing.

3. The combination of claim 2 wherein said releasable mounting means includes opposite side attaching arms projecting outwardly from said second side of said housing, the outer ends of said arms being hooked and removably hook-engaged with opposite side portions of said spray head for clamping said adapter cup between said housing and said spray head.

4. The combination of claim 3 wherein the interior of said housing is partitioned into a liquid receiving chamber and a rotor chamber, a bladed rotor journalled on said shaft within said rotor chamber, said liquid inlet means opening into said liquid receiving chamber, means communicating said liquid receiving chamber with one peripheral portion of said rotor chamber, said outlet means opening outwardly of said rotor chamber at a point spaced peripherally about said rotor chamber from the point of communication of said liquid receiving chamber with said rotor chamber.

5. In combination with a hand-held spray head of the type including a flexible water inlet supply hose for connection to a remote source of liquid under pressure and wherein said head includes a plurality of liquid spray jet outlets opening outwardly of one side of said head, a scrubber assembly including a housing having first and second remote sides, said housing including rotary scrubbing means journalled therefrom and facing and disposed outwardly of said first side, said second side including liquid inlet means, liquid motor means in said housing including a rotary output shaft upon which said scrubbing means is mounted, said housing including liquid outlet means, said motor means being operative to receive liquid under pressure from said inlet means, discharge liquid from said liquid outlet means and to develop rotary torque input to said shaft as a result of a liquid flow under pressure therethrough from said inlet means through said outlet means, said housing and head including means operative to releasably mount said housing from said head with at least one of said spray jet outlets in sealed communication with said inlet means, said plurality of liquid spray jet outlets opening outwardly of said one side of said head comprising selectively usable water outlets, said liquid inlet means comprising a single inlet communicated with one of said selectively usable spray jet outlets, said second side additionally including resilient abutment means projecting outwardly therefrom against which the other of said liquid spray jet outlets are abutted for support of housing therefrom.

6. The combination of claim 5 wherein said releasable mounting means includes remote attaching arms projecting outwardly of said second side thereof including hooked ends removably hook-engaged with opposite side portions of said spray head for support of said housing from said spray head.

7. The combination of claim 6 wherein the interior of said housing is partitioned into a liquid receiving chamber and a rotor chamber, a bladed rotor journalled on said shaft within said rotor chamber, said liquid inlet means opening into said liquid receiving chamber, means communicating said liquid receiving chamber with one peripheral portion of said rotor chamber, said outlet means opening outwardly of said rotor chamber at a point spaced peripherally about said rotor chamber from the point of communication of said liquid receiving chamber with said rotor chamber.

8. The combination of claim 5 wherein said scrubbing means includes a disk-shaped circular brush head equipped with bristles spaced about and projecting outwardly of one axial end of said head facing outwardly of said first side of said housing.

* * * * *